US005713619A

United States Patent [19]

DuBois et al.

[11] Patent Number: 5,713,619

[45] Date of Patent: Feb. 3, 1998

[54] BEVERAGE CUP CARRIER

[75] Inventors: John P. DuBois, Windham; Richard C. Sweeney, Falmouth, both of Me.

[73] Assignee: Tenneco Packaging Inc., Evanston, Ill.

[21] Appl. No.: 596,516

[22] Filed: Feb. 5, 1996

[51] Int. Cl.[6] ..... B65D 1/36

[52] U.S. Cl. ..... 294/159; 206/519; 206/564; 229/406

[58] Field of Search ..... 294/27.1, 32, 33, 294/87.1, 87.2, 144, 159, 143, 172; 206/518–520, 557, 562–564; 220/23.8, 23.83; 229/406, 407, 904; D7/553, 554; D9/341, 345

[56] References Cited

U.S. PATENT DOCUMENTS

| | | | |
|---|---|---|---|
| D. 236,575 | 9/1975 | Vigue . | |
| D. 249,620 | 9/1978 | Vigue . | |
| D. 249,622 | 9/1978 | Vigue . | |
| D. 249,769 | 10/1978 | Vigue . | |
| D. 250,091 | 10/1978 | Jewell | D9/341 |
| D. 250,243 | 11/1978 | Vigue . | |
| D. 253,561 | 12/1979 | Vigue . | |
| D. 254,956 | 5/1980 | Gilley . | |
| D. 274,110 | 6/1984 | Vigue . | |
| D. 279,259 | 6/1985 | Bixler et al. . | |
| D. 289,010 | 3/1987 | Vigue . | |
| D. 290,580 | 6/1987 | Vigue . | |
| D. 302,114 | 7/1989 | Ashby . | |
| D. 302,122 | 7/1989 | Ashby . | |
| D. 305,713 | 1/1990 | Seifried | D7/554 |
| D. 309,258 | 7/1990 | Vigue . | |
| D. 310,027 | 8/1990 | Bixler . | |
| D. 311,847 | 11/1990 | Meisner . | |
| D. 319,579 | 9/1991 | Vigue . | |
| D. 331,008 | 11/1992 | Vigue . | |
| 2,854,790 | 10/1958 | Hartung | 229/406 |

(List continued on next page.)

FOREIGN PATENT DOCUMENTS

| | | | |
|---|---|---|---|
| 2032886 | 5/1980 | United Kingdom | 229/407 |

OTHER PUBLICATIONS

Carry Safe® Beverage Carriers and Trays, Packaging Corporation of America, Evanston, IL, no date.

Carry–Safe® Trays. A better way to go., Diamond International Corporation.Fiber Products Division, New York, NY, no date.

(List continued on next page.)

*Primary Examiner*—Dean Kramer
*Attorney, Agent, or Firm*—Arnold, White & Durkee

[57] ABSTRACT

A beverage cup carrier includes multiple pockets arranged in laterally spaced relation. Each pocket includes a bottom wall, a plurality of conical side wall portions, and a plurality of circumferentially spaced webs. The side wall portions encompass the bottom wall and extend upwardly and outwardly therefrom. The side wall portions are circumferentially spaced from each other and form surface portions of a curved surface of an imaginary inverted cone. The webs interconnect the side wall portions and extend radially inward from the curved surface of the imaginary inverted cone. Each of the webs includes a flat central section and a pair of opposing side sections connecting the central section to adjacent ones of the conical side wall portions. The central section extends upwardly and outwardly from the bottom wall. The pair of opposing side sections of each of the webs form surface portions of a curved surface of a respective imaginary upright cone. The central section of each of the webs defines a truncated parabolic conic section of the respective imaginary upright cone. Each of the webs is vertically spaced from the bottom wall to define a respective first elongated slot therebetween. An outwardly curved rim portion is disposed above and spaced from the central section of each of the webs to define a respective second elongated slot therebetween. A plurality of denesting lugs interconnect the bottom wall and respective ones of the side wall portions.

20 Claims, 6 Drawing Sheets

U.S. PATENT DOCUMENTS

| | | | |
|---|---|---|---|
| 3,915,371 | 10/1975 | Crabtree . | |
| 3,942,671 | 3/1976 | Florian . | |
| 4,208,006 | 6/1980 | Bixler et al. . | |
| 4,218,008 | 8/1980 | Veilleux . | |
| 4,381,847 | 5/1983 | Bessett et al. . | |
| 4,718,555 | 1/1988 | Amberg . | |
| 4,823,959 | 4/1989 | Bixler . | |
| 5,096,065 | 3/1992 | Vigue . | |
| 5,335,814 | 8/1994 | Hepp | 206/518 |

OTHER PUBLICATIONS

Carry–Safe® (2–cup and 4–cup sizes), Diamond International Corporation.Fiber Productions Division, New York, NY, no date.

Carrysafe® Trays. Minimize the Spills! Maximize the Fun!, PCA Specialty Packaging Group, A Tenneco Company, Evanston, IL, 1994.

Supporting Cast, Packaging Corporation of America, A Tenneco Company, Evanston, IL, no date.

Readying for World.Class, A Report of Our Progress. Employee Annual Report 1993, Packaging Corporation of America, Evanston, IL, p. 32.

BEVERAGE CUP CARRIER

FIELD OF THE INVENTION

The present invention relates generally to disposable carry-out food and beverage carriers. More particularly, the invention relates to a compact, high-strength beverage cup carrier having one or more pockets adapted to hold cups of a wide range of sizes and having strategically positioned denesting lugs to facilitate denesting of one such carrier from another identical carrier.

BACKGROUND OF THE INVENTION

With the popularization of fast food establishments and convenience stores, it is important that the customer can readily handle the purchased food and beverage items in a facile, convenient and safe manner. In many such establishments where the purchased items are for carry-out, the clerk will deposit all such items in a paper bag or the like after lids or caps have been secured to the tops of the beverage containers and the food items have been wrapped in suitable sheets of wrapping paper or foil. Notwithstanding the care exercised by the clerk in placing the items in the bag, the beverage containers will oftentimes accidently tip over in the bag causing leakage of the beverage within the bag and deleteriously affecting the palatability of the bagged food items. Leakage becomes a prevalent problem, particularly where the lid or cap is provided with slits to enable the end of a straw to be readily inserted therethrough while the lid or cap remains in place or where the lid or cap is not properly assembled on the container.

Where disposable carriers are utilized in lieu of bags for handling such food and beverage items, such carriers are frequently awkward to handle, require some setting up by the clerk before use, are inherently weak and susceptible to tearing and bending, are expensive and cannot be readily stacked for storage in a compact bundle, are difficult to denest from one another, and/or are not capable of properly accommodating beverage containers which vary in size and shape over a wide range.

It has been found to be most convenient and desirable to bag the food items and to accommodate two or more beverage containers in a separate carrier. Not only are the food items (e.g., sandwiches, french fried potatoes, etc.) separated from the beverage items in such a procedure, but a plurality of beverage items can be manually carded simultaneously without difficulty.

Beverages in most fast food establishments and convenience stores are normally sold in various sizes (e.g., small, medium, and large or jumbo) of containers. Such containers are usually formed of treated paper stock or foam plastic material and have tapered rounded sides and flat bottoms. The open upper end of each container is normally defined by a small, outwardly projecting bead. The various size containers generally have substantially the same configuration but vary primarily in the height or width dimension.

SUMMARY OF THE INVENTION

Thus, an object of the present invention is to provide a beverage cup carrier which can accommodate beverage cups of a wide range of sizes, and yet can form a compact bundle or stack suitable for storage or bulk shipment.

Another object of the present invention is to provide a beverage cup carrier which is ergonomically comfortable and easy to manually handle.

Yet another object of the present invention is to provide a beverage cup carrier which can readily nest with like carriers so as to form a compact bundle or stack, and yet can readily denest from such like carriers.

A further object of the present invention is to provide a beverage cup carrier having enhanced torsional strength such that the carrier can be readily handled with one hand even when the carrier is fully loaded with filled beverage cups.

In accordance with one embodiment of the present invention, the foregoing objectives are realized by providing a beverage cup carrier including a plurality of pockets arranged in laterally spaced relation. Each pocket includes a bottom wall, a plurality of generally conical side wall portions, and a plurality of circumferentially spaced webs. The side wall portions encompass the bottom wall and extend upwardly and outwardly from the bottom wall. The side wall portions are circumferentially spaced from each other and form surface portions of a curved surface of an imaginary inverted cone. The webs interconnect the plurality of side wall portions and extend radially inward from the curved surface of the imaginary inverted cone. Each of the webs includes a generally flat central section and a pair of opposing side sections connecting the central section to adjacent ones of the conical side wall portions. The central section extends upwardly and outwardly from the bottom wall. The pair of opposing side sections of each of the webs forms surface portions of a curved surface of a respective imaginary upright cone. The central section of each of the webs defines a truncated parabolic conic section of the respective imaginary upright cone. Each of the webs is vertically spaced from the bottom wall to define a respective first elongated slot therebetween. An outwardly curved rim portion is disposed above and spaced from the central section of each of the webs to define a respective second elongated slot therebetween. A plurality of denesting lugs interconnect the bottom wall and respective ones of the side wall portions. The denesting lugs extend radially inward from the respective ones of the side wall portions.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
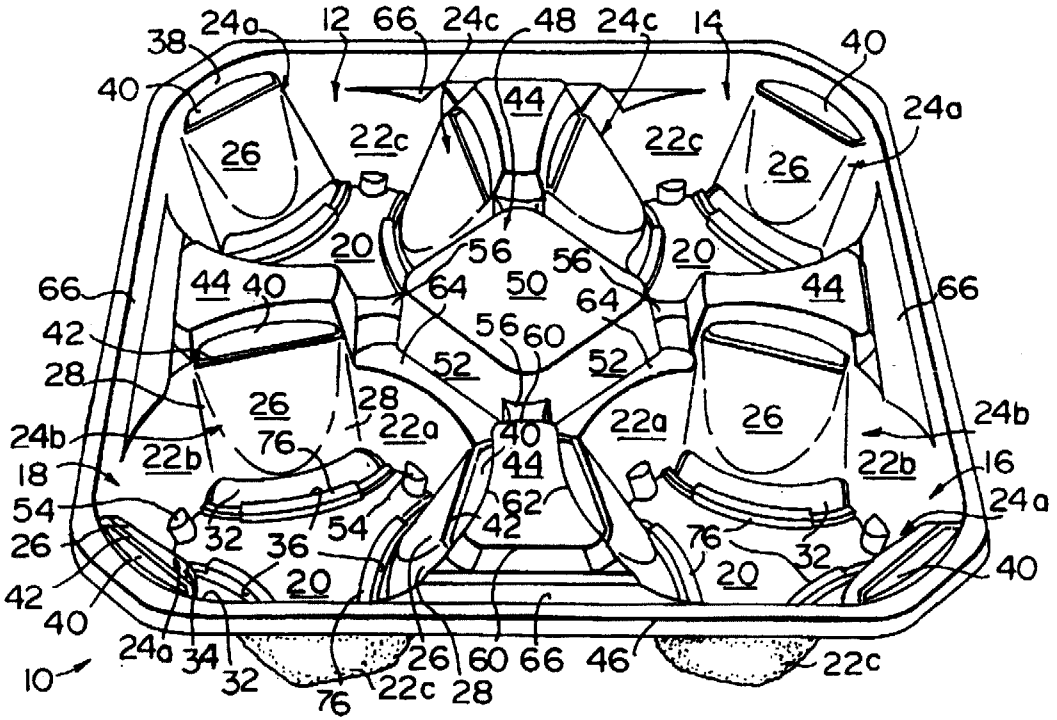
FIG. 1 is a perspective view of a beverage cup carrier embodying the present invention.
Figure 3:
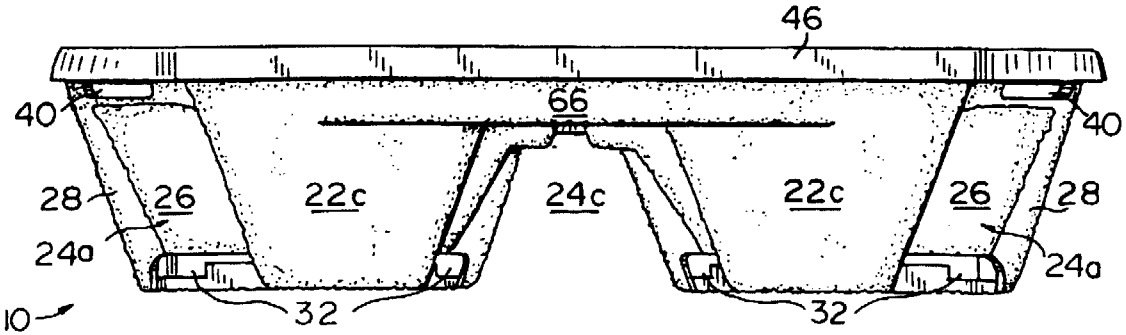
FIG. 3 is a side elevational view of the beverage cup carrier in FIG. 1.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DETAILED DESCRIPTION OF THE PREFERRED EMBODIMENTS

Turning now to the drawings, FIGS. 1–6 illustrate a beverage cup carrier 10 composed of a fairly elastic material such as molded fiber, thermoformed plastic, or the like. The beverage cup carrier 10 includes four pockets 12, 14, 16, and 18 arranged in laterally spaced relation. Although the illustrated carrier 10 includes four pockets 12, 14, 16, and 18, the number of pockets may be varied to be less than or greater than four pockets. Each pocket includes a bottom wall 20, a plurality of generally conical side wall portions 22*a–c*, and a plurality of circumferentially spaced webs 24*a–c*. The plurality of side wall portions 22*a–c* preferably include three side wall portions 22*a–c* circumferentially spaced at equal distances from each other. The side wall portions 22*a–c* encompass the bottom wall 20 and extend upwardly and outwardly from the bottom wall 20. The side wall portions 22*a–c* form surface portions of a curved surface of an imaginary inverted cone having an imaginary point located below the bottom wall 20. Four imaginary inverted cones are associated with the four respective pockets 12, 14, 16, and 18—a different imaginary inverted cone defining the side wall portions 22*a–c* of each pocket.

Figure 2:
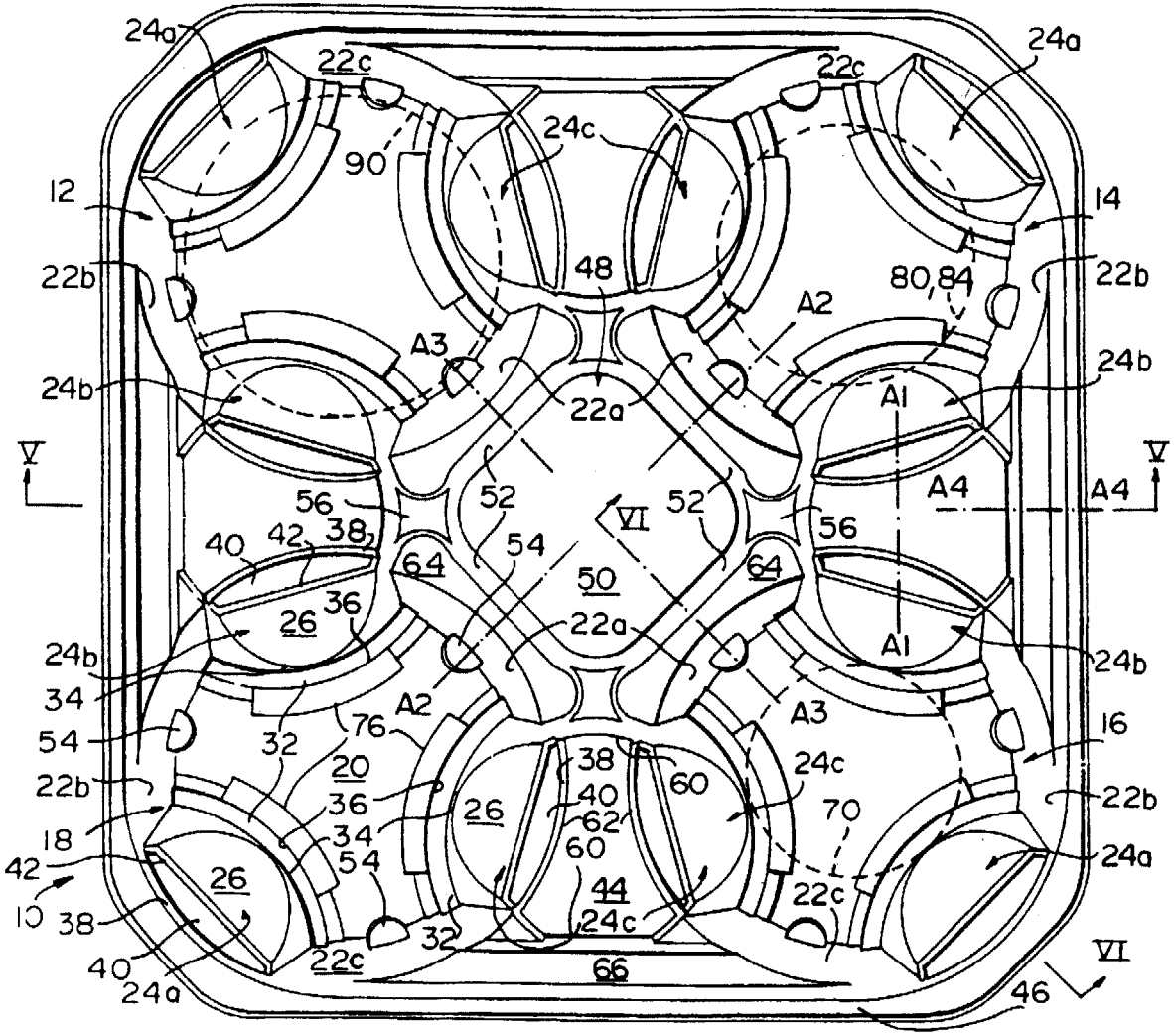
FIG. 2 is a top plan view of the beverage cup carrier in FIG. 1.
Figure 4:
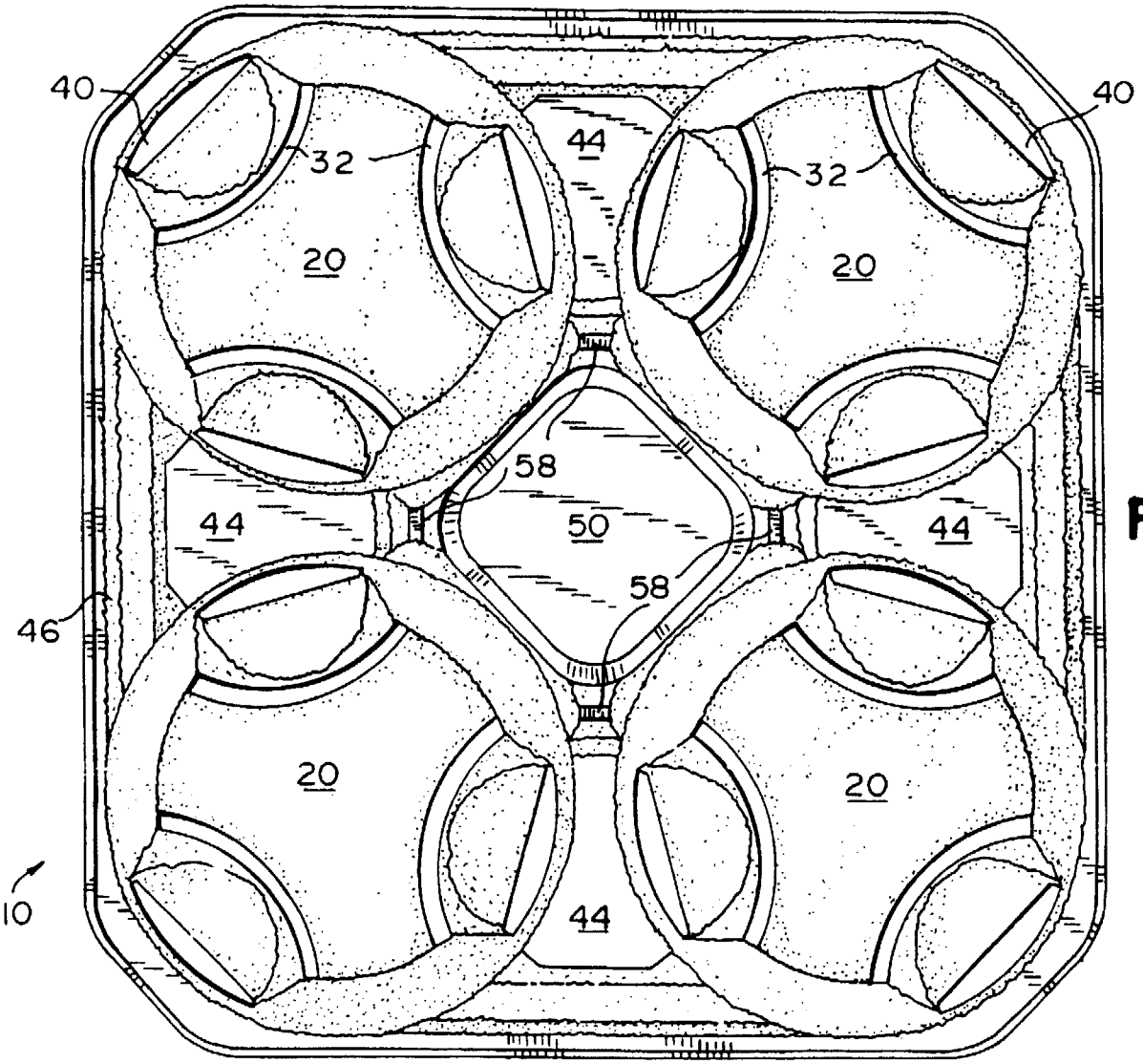
FIG. 4 is a bottom plan view of the beverage cup carrier in FIG. 1.
Figure 5:
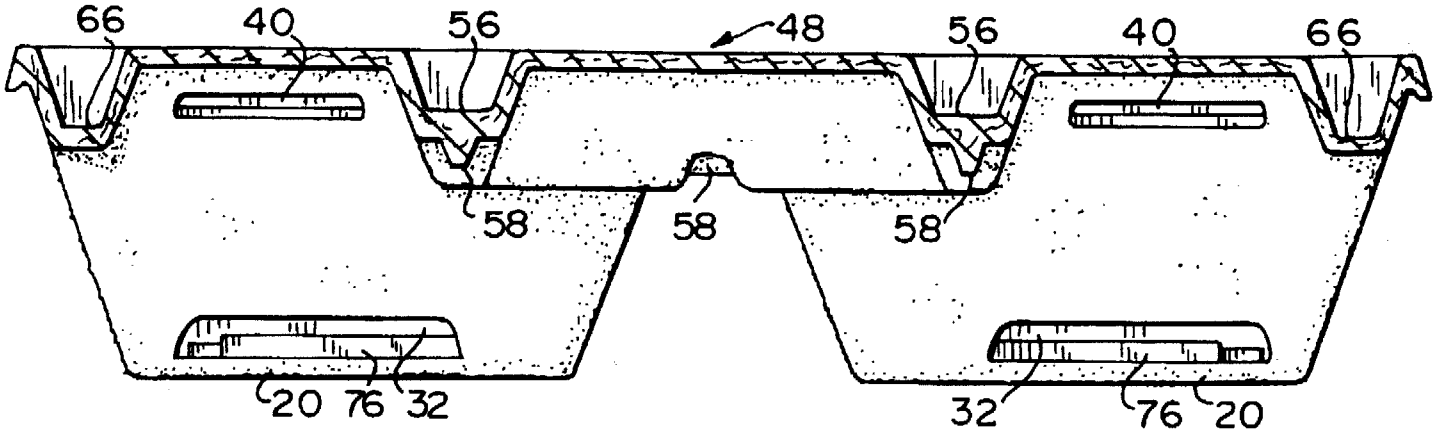
FIG. 5 is a section view taken generally along line 5—5 in FIG. 2.
Figure 6:
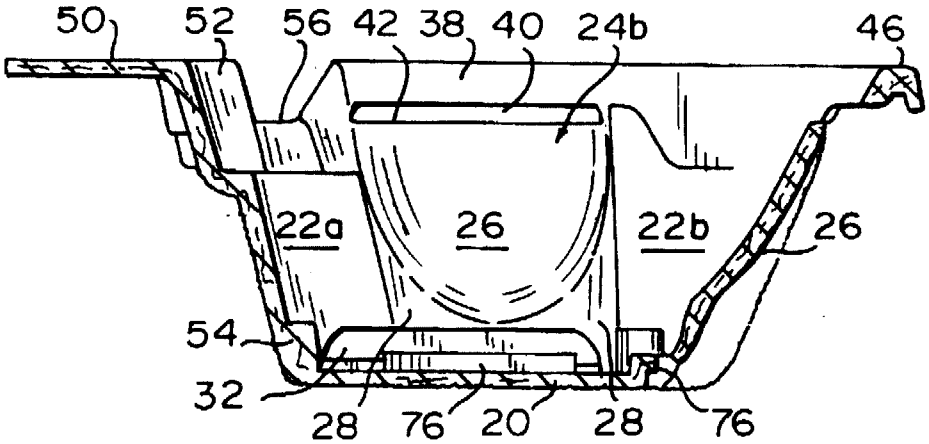
FIG. 6 is a section view taken generally along line 6—6 in FIG. 2.

With respect to many elements common to each of the four pockets in FIGS. 1 and 2, reference numerals are used to designate only the elements associated with one of the pockets to avoid unnecessary clutter of reference numerals. It should, however, be understood that the four pockets 12, 14, 16, and 18 are identical in construction.

The webs 24*a–c* interconnect the side wall portions 22*a–c* and extend radially inward from the curved surface of the imaginary inverted cone. Each of the webs 24*a–c* includes a generally flat central section 26 and a pair of opposing side sections 28 connecting the central section 26 to adjacent ones of the conical side wall portions 22*a–c*. The central section 26 extends upwardly and outwardly from the bottom wall 20 and is either planar or curved slightly outward relative to the interior of the pocket. The pair of opposing side sections 28 of each of the webs 24*a–c* forms surface portions of a curved surface of a respective imaginary upright cone having an imaginary point located above the level of beverage cup carrier 10. The central section 26 of each of the webs 24*a–c* defines a truncated parabolic conic section of the respective imaginary upright cone.

With respect to the three webs 24*a–c* of a particular pocket, a different imaginary upright cone defines the pair of opposing side sections 28 and the truncated parabolic conic section 26 of each web. Therefore, three imaginary upright cones are used to define the pair of opposing side sections 28 and the truncated parabolic conic section 26 of the three respective webs 24*a–c*. Although three imaginary upright cones are used to create the three respective webs 24*a–c* for each pocket, only eight imaginary upright cones are necessary to generate the twelve webs 24*a–c* of the four pockets 12, 14, 16, and 18 combined because some of the imaginary upright cones are "shared" between adjacent ones pockets. To obtain this count of eight imaginary upright cones, one imaginary upright cone is used to create the back-to-back webs 24*c* and 24*c* of the respective pockets 12 and 14; one imaginary upright cone is used to create the back-to-back webs 24*b* and 24*b* of the respective pockets 14 and 16; one imaginary upright cone is used to create the back-to-back webs 24*c* and 24*c* of the respective pockets 16 and 18; one imaginary upright cone is used to create the back-to-back webs 24*b* and 24*b* of the respective pockets 12 and 18; and, finally, four different imaginary upright cones are used to create the comer webs 24*a* of the four respective pockets 12, 14, 16, and 18.

Each of the webs 24*a–c* of a particular pocket is vertically spaced from the bottom wall 20 to define a respective first elongated slot 32 therebetween. The first elongated slot 32 is curvilinear in shape and is bounded by a curved lower edge 34 of the respective web and a curved outer edge 36 of the bottom wall 20. An outwardly curved rim portion 38 is disposed above and spaced from the central section 26 of each of the webs 24*a–c* to define a respective second elongated slot 40 therebetween. The second elongated slot 40 is bounded by a straight upper edge 42 of the respective central section 26 and a curved lower edge of the respective rim portion 38.

The beverage cup carrier 10 is designed to be ergonomically comfortable and easy to manually handle. In particular, the carrier 10 includes four thumb-gripping areas 44 which allow a user to hold the carrier 10. To hold the carrier 10 using one of the thumb-gripping areas 44, the user places his or her thumb on the thumb-gripping area 44 and wraps the remainder of his or her fingers about the nearby portion of the outer carrier rim 46 to support the bottom wall 20 of the carrier 10.

The beverage cup carrier 10 includes a central logo platform 48 formed by a generally horizontal square area 50 and four generally vertical sides 52 extending downward from the square area 50. The square area 50 provides advertising space for embossing or application of a label. The central logo platform 48 also assists in manufacturing of the beverage cup carrier 10 from molded fiber by supporting the weight of the carrier 10 during the molded fiber process. The central logo platform 48 may be modified to change the shape of the square area 50 or to create a central recess or indentation capable of accepting condiments.

The beverage cup carrier 10 is designed to readily nest with like carriers so as to form a compact bundle or stack suitable for storage or bulk shipment, and yet permit the carrier 10 to be readily denested from such like carriers. A plurality of denesting lugs 54 interconnect the bottom wall 20 and respective ones of the side wall portions 22*a–c*. The denesting lugs 54 extend radially inward from the respective ones of the side wall portions 22*a–c*. Each of the denesting lugs 54 is circumferentially located approximately at a center of a respective one of the side wall portions 22*a–c*. A cross-section of each of the denesting lugs 54 taken in a plane generally parallel to the bottom wall 20 is generally semi-circular in shape.

Figure 7:
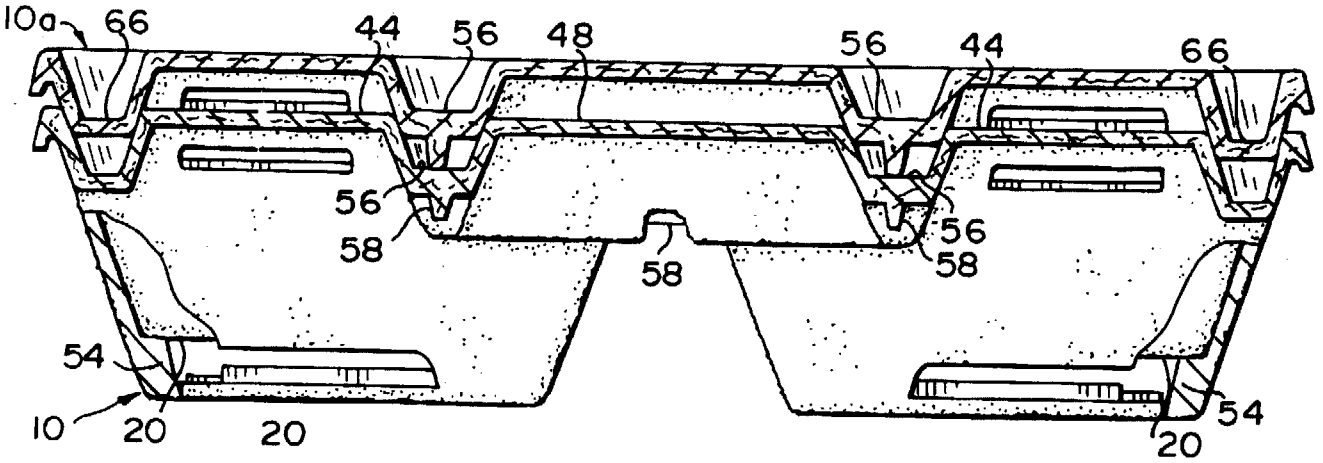
FIG. 7 is a section view similar to FIG. 5 showing the beverage cup carrier nested with a like carrier, portions of the carrier being broken away to reveal denesting lugs.

Referring to FIG. 7, when the beverage cup carrier 10 is nested with a like carrier 10*a* positioned above the beverage cup carrier 10, the denesting lugs 54 support the bottom walls of the like carrier 10*a* to create a small air gap between the side wall portions of the like carrier 10*a* and the side wall portions 22*a–c* of the beverage cup carrier 10. The bottom walls of the like carrier 10*a* rest on the denesting lugs 54 to maintain the like carrier slightly separated from the beverage cup carrier 10. This slight separation facilitates denesting of the like carrier from the beverage cup carrier 10. In addition to the denesting lugs 54 located at the bottom wall 20 of each pocket, the beverage cup carrier 10 is provided with denesting ribs 56 which interconnect the central logo platform 48 and the thumb-gripping areas 44. Like the denesting lugs 54, the denesting ribs 56 assist in maintaining a slight degree of separation between the beverage cup carrier 10 and a like carrier 10*a* nested above the beverage cup carrier 10. To maintain this slight degree of separation, the denesting ribs 56 support underside ribs on the like carrier 10*a* which are akin to the underside ribs 58 of the beverage cup carrier 10.

Referring back to FIG. 2, the beverage cup carrier 10 is designed to withstand significant torsional stresses such that the carrier 10 can be readily handled with one hand even when the carrier 10 is fully loaded with filled beverage cups. Various elements of the beverage cup carrier 10 provide it with torsional rigidity. For example, each thumb-gripping area 44 is defined by a pair of opposing edges 60 bridged by a pair of opposing concave edges 62. The opposing concave edges 62 form the curved upper edges of the associated rim portions 38. This configuration resists bending of the beverage cup carrier 10 along axes A1. Further torsional rigidity is imparted to the beverage cup carrier 10 about axes A2 and A3 by a combination of the four side wall portions 22*a* of the pockets 12, 14, 16, and 18, the four generally vertical sides 52 of the central logo platform 48, and the four generally horizontal ledges 64 bridging the platform sides 52 and the side wall portions 22*a*. The intersection of the conical side wall portions 22*a* and the respective horizontal planar ledges 64 provides torsional rigidity. Similarly, the intersection of the horizontal planar ledges 64 and the respective generally vertical platform sides 52 creates torsional resistance. The horizontal displacement of the generally vertical platform sides 52 from the respective conical side wall portions 22*a* also provides strength. To provide the beverage cup carrier 10 with torsional rigidity about axes A4, the carrier 10 includes four trough-like trusses 66 which interconnect the carrier rim 46 to the respective thumb-gripping areas 44.

Figure 8:
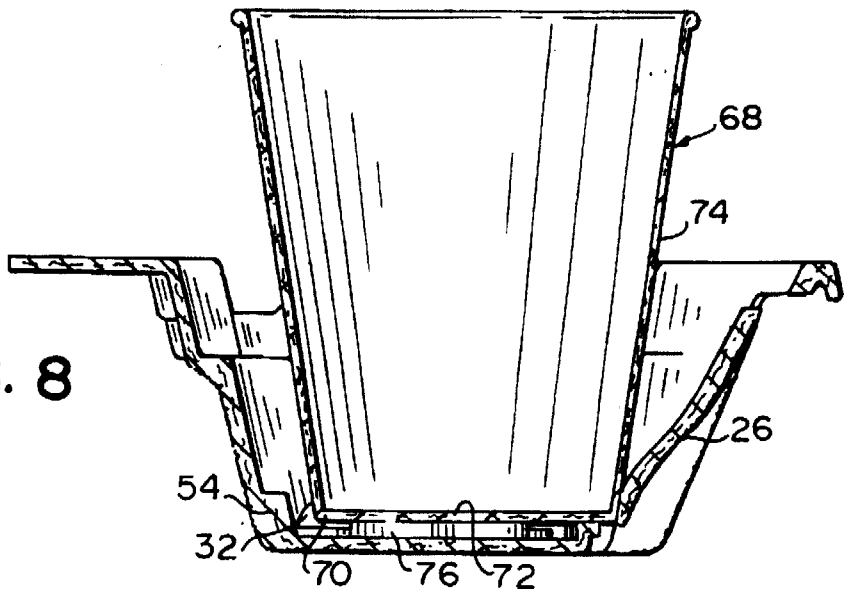
FIG. 8 is a section view similar to FIG. 6 showing a small cup inserted into one of the pockets of the beverage cup carrier.
Figure 10:
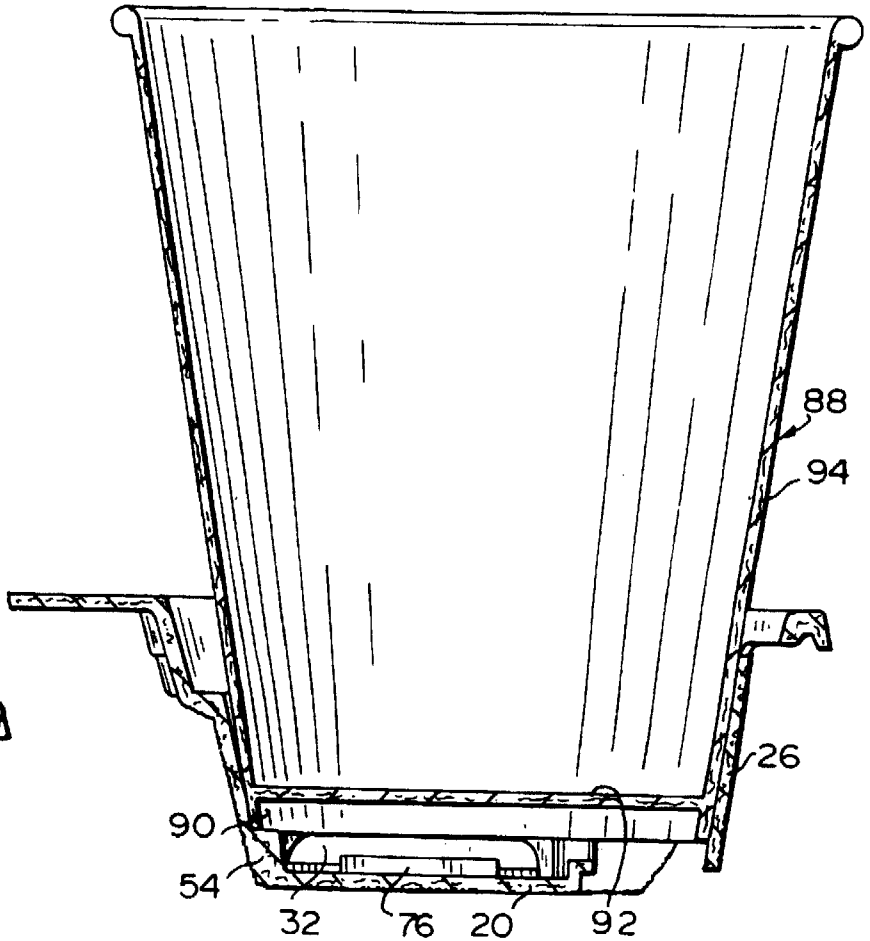
FIG. 10 is a section view similar to FIG. 6 showing a wide cup inserted into one of the pockets of the beverage cup carrier.
Figure 9:
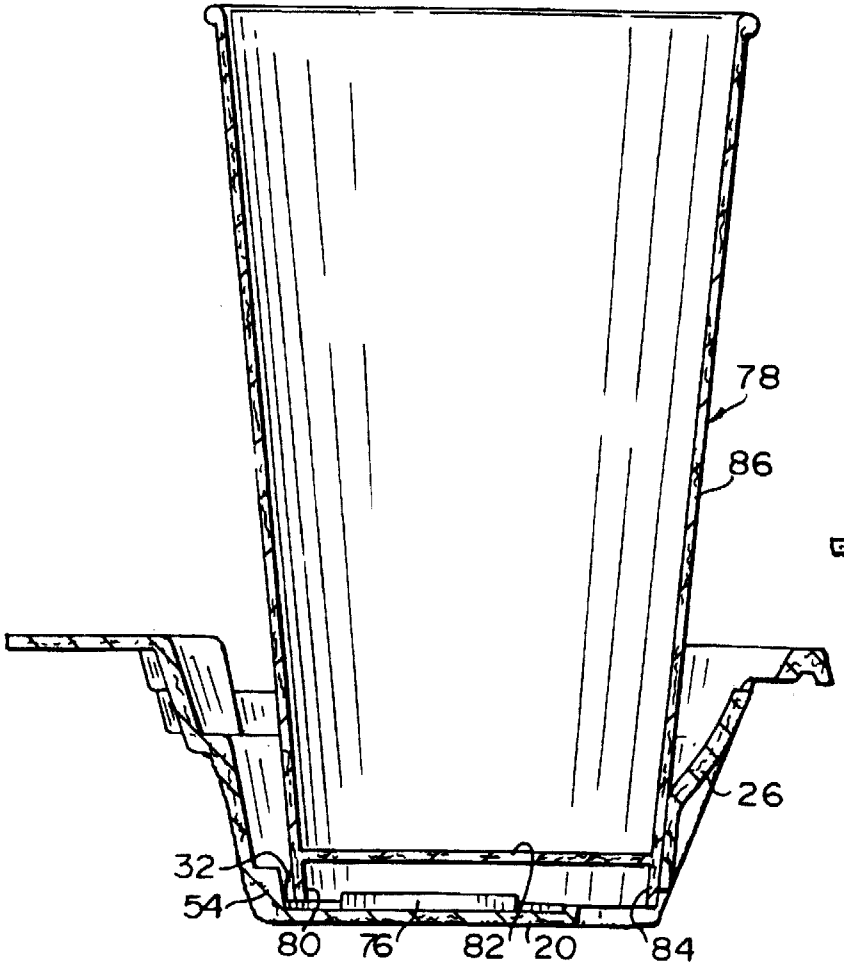
FIG. 9 is a section view similar to FIG. 6 showing a medium cup inserted into one of the pockets of the beverage cup carrier.

Referring to FIGS. 8–10, the beverage cup carrier 10 is designed to accommodate beverage cups of a wide range of diameters and volumes. In the preferred embodiment, the beverage cup carrier 10 can accommodate beverage cups having bottom diameter dimensions ranging from about 2 inches to about 3.125 inches and having volumes ranging from about 8 ounces to about 44 ounces. The manner in which the beverage cup carrier 10 holds cups of different sizes is described below with respect to a small cup, medium cup, and a wide cup.

Referring first to FIG. 8, in response to inserting a small cup 68 downward into one of the pockets 12, 14, 16, and 18, the leading peripheral edge 70 of the cup bottom 72 contacts the lowermost portions of the flat central sections 26 of the webs 24*a*–*c* of the receiving pocket and then deflects the webs 24*a*–*c* slightly outward. The elongated slots 32 and 40 facilitate the outward deflection of the webs 24*a*–*c* by weakening the stiffness thereof. If the small cup 68 is not quite centered relative to the pocket as it is inserted therein, the three webs 24*a*–*c* serve to center the cup 68. The small cup 68 is pushed downward into the pocket until the bottom 72 of the cup 68 contacts steps 76 formed by the bottom wall 20. Once the cup bottom 72 reaches the steps 76, the small cup 68 is retained in the pocket by virtue of the inward pressure applied by the inwardly-biased webs 24*a*–*c* to the conical side wall 74 of the small cup 68. The inward pressure applied by the inwardly-biased webs 24*a*–*c* to the conical side wall 74 of the small cup 68 creates an interference fit therebetween. Since the cup bottom 72 sits upon the steps 76, the cup bottom 72 is vertically spaced from the non-stepped portion of the bottom wall 20 by a distance approximately equal to the height of the steps 76. The diameter of the small cup 68 is sufficiently small that the peripheral edge 70 of the cup bottom 70 is located radially inward relative to the denesting lugs 54 so that the denesting lugs 54 provide no support to the small cup 68. The approximate position of the peripheral bottom edge 70 relative to the denesting lugs 54 is indicated by the dotted lines in the pocket 16 in FIG. 2.

Referring next to FIG. 9, in response to inserting a medium cup 78 into one of the pockets 12, 14, 16, and 18, the leading peripheral edge 80 of the cup bottom 82 contacts lower portions of the flat central sections 26 of the webs 24*a*–*c* of the receiving pocket and then deflects the webs 24*a*–*c* outward. Once again, the elongated slots 32 and 40 facilitate the outward deflection of the webs 24*a*–*c*. If the medium cup 78 is not quite centered relative to the pocket as it is inserted therein, the three webs 24*a*–*c* serve to center the cup 78. The medium cup 78 is pushed downward into the pocket until the bottom 82 of the cup 78 contacts the bottom wall 20. Unlike the small cup 68, the medium cup 78 does not contact the steps 76. That is, downward movement of the medium cup 78 is not impeded by the steps 76. Rather, the medium cup 78 typically includes a downwardly-extending lower rim 84 which encompasses, but does not sit upon, the steps 76. The downwardly-extending lower rim 84 encircles the steps 76 immediately adjacent to the opposing edges thereof so as to essentially engage the opposing edges of the steps 76. The approximate position of the lower rim 84 relative to the steps 76 is indicated by the dotted lines in the pocket 14 in FIG. 2. Such engagement of the steps 76 inhibits tilting of the cup 78 while handling the beverage cup carrier 10. Once the cup bottom 82 reaches the bottom wall 20 while encompassing the steps 76, the medium cup 78 is retained in the pocket by virtue of the inward pressure applied by the inwardly-biased webs 24*a*–*c* to the conical side wall 86 of the medium cup 78. The diameter of the medium cup 78 is sufficiently small that the peripheral edge 80 of the cup bottom 82 is located radially inward relative to the denesting lugs 54 so that the denesting lugs 54 provide no support to the medium cup 78.

Referring now to FIG. 10, the beverage cup carrier 10 is also designed to accommodate a wide beverage cup 88, i.e., a large beverage cup having a large bottom diameter. In response to inserting a wide cup 88 into one of the pockets 12, 14, 16, and 18, the leading peripheral edge 90 of the cup bottom 92 contacts upper portions of the flat central sections 26 of the webs 24*a*–*c* of the receiving pocket and then deflects the webs 24*a*–*c* outward by a substantial amount. The elongated slots 32 and 40 greatly facilitate the outward deflection of the webs 24*a*–*c*. Due to the large bottom diameter of the wide cup 88, the wide cup 88 must be substantially centered relative to the pocket prior to its insertion. As the wide cup 88 is pushed downward into the pocket, the webs 24*a*–*c* (especially the central sections 26 thereof) are deflected outward to conform to the shape of the incoming side wall 94 of the cup 88. The webs 24*a*–*c* serve to cradle the side wall 94 of the cup 88. The wide cup 88 is pushed downward into the pocket until the bottom 92 of the cup 88 contacts the denesting lugs 54. Once the cup bottom 92 reaches the denesting lugs 54, the wide cup 88 is retained in the pocket by virtue of the inward pressure applied by the inwardly-biased webs 24*a*–*c* to the conical side wall 94 of the wide cup 88. The wide cup 88 does not contact the rim portions 38. Unlike some prior art beverage cup carriers, the beverage cup carrier 10 does not employ and does not require any sort of stabilizing shoulder to prevent tipping of the wide cup 88 or to support the larger squat cup 88 in any fashion. Since the cup bottom 92 sits upon the denesting lugs 54, the cup bottom 92 is vertically spaced from the non-stepped portion of the bottom wall 20 by a distance approximately equal to the height of the denesting lugs 54. The approximate position of the peripheral bottom edge 90 relative to the steps 76 and the denesting lugs 54 is indicated by the dotted lines in the pocket 12 in FIG. 2.

Although the beverage cup carrier 10 is designed to hold wide beverage cups 88, the carrier 10 is still designed to keep its length and width dimensions to a minimum and to form a compact bundle or stack suitable for storage or bulk shipment. Since the denesting lugs 54 support a peripheral bottom portion 90 of the wide cup 88, the width dimensions of the pocket can be smaller than if the wide cup 88 were to contact the non-stepped portion of the bottom wall 20. Since the wide cup 88 is elevated relative to the non-stepped portion of the bottom wall 20, the width dimensions of the pocket only must be sufficiently large to accommodate the wide cup 88 at this elevated level. Otherwise, if the wide cup 88 were to contact the non-stepped portion of the bottom wall 20, the pocket would need to be widened to accommodate the wide cup 88 at the lower, non-elevated level.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A pocket of a beverage cup carrier, said pocket comprising:

a bottom wall;

a plurality of generally conical side wall portions encompassing said bottom wall and extending upwardly and outwardly from said bottom wall, said side wall portions being circumferentially spaced from each other; and a plurality of circumferentially spaced, webs interconnecting said plurality of side wall portions, said webs extending radially inwardly relative to said side wall portions, each of said webs being vertically spaced from said bottom wall to define a respective elongated slot therebetween, each of said webs including a generally flat central section and a pair of opposing side sections connecting said central section to adjacent ones of said conical side wall portions, said central section extending upwardly and outwardly from said bottom wall.

2. The pocket of claim 1, further including a plurality of denesting lugs interconnecting said bottom wall and respective ones of said side wall portions, said denesting lugs extending radially inward from said respective ones of said side wall portions.

3. The pocket of claim 2, wherein said denesting lugs support a peripheral bottom portion of a large beverage cup to cause said large beverage cup to be vertically spaced from said bottom wall of the pocket in response to inserting said large beverage cup into the pocket.

4. A pocket of a beverage cup carrier, said pocket comprising:

a bottom wall;

a plurality of generally conical side wall portions encompassing said bottom wall and extending upwardly and outwardly from said bottom wall, said side wall portions being circumferentially spaced from each other;

a plurality of circumferentially spaced, inwardly extending webs interconnecting said plurality of side wall portions, each of said webs being vertically spaced from said bottom wall to define a respective first elongated slot therebetween, each of said webs including a generally flat central section and a pair of opposing side sections connecting said central section to adjacent ones of said conical side wall portions, said central section extending upwardly and outwardly from said bottom wall; and an outwardly curved rim portion disposed above and spaced from said central section of each of said webs to define a respective second elongated slot therebetween.

5. The pocket of claim 4, wherein said generally flat central section of each of said webs is caused to curve outward in response to inserting a larger cup into the pocket such that said central section conforms to the shape of the cup.

6. The pocket of claim 4, wherein said second elongated slot is bounded by a straight upper edge of said respective central section and a curved lower edge of said respective rim portion.

7. A pocket of a beverage cup carrier, said pocket comprising:

a bottom wall;

a plurality of generally conical side wall portions encompassing said bottom wall and extending upwardly and outwardly from said bottom wall, said side wall portions being circumferentially spaced from each other, said plurality of side wall portions including three side wall portions circumferentially spaced at equal distances from each other; and a plurality of circumferentially spaced, inwardly extending webs interconnecting said plurality of side wall portions, each of said webs being vertically spaced from said bottom wall to define a respective first elongated slot therebetween, each of said webs including a generally flat central section and a pair of opposing side sections connecting said central section to adjacent ones of said conical side wall portions, said central section extending upwardly and outwardly from said bottom wall, said plurality of webs including three webs circumferentially spaced at equal distances from each other.

8. A pocket of a beverage cup carrier, said pocket comprising:

a bottom wall;

a plurality of generally conical side wall portions encompassing said bottom wall and extending upwardly and outwardly from said bottom wall, said side wall portions being circumferentially spaced from each other, said side wall portions forming surface portions of a curved surface of an imaginary cone; and a plurality of circumferentially spaced, inwardly extending webs interconnecting said plurality of side wall portions, each of said webs being vertically spaced from said bottom wall to define a respective first elongated slot therebetween, each of said webs including a generally flat central section and a pair of opposing side sections connecting said central section to adjacent ones of said conical side wall portions, said central section extending upwardly and outwardly from said bottom wall, said webs extending radially inward from said curved surface of said imaginary inverted cone.

9. The pocket of claim 8, wherein said central section of each of said webs is defined by a truncated parabolic conic section of a respective imaginary upright cone.

10. A pocket of a beverage cup carrier, said pocket comprising:

a bottom wall;

a plurality of generally conical side wall portions encompassing said bottom wall and extending upwardly and outwardly from said bottom wall, said side wall portions being circumferentially spaced from each other and forming surface portions of a curved surface of an imaginary inverted cone; and a plurality of circumferentially spaced webs interconnecting said plurality of side wall portions and extending radially inward from said curved surface of said imaginary inverted cone, each of said webs including a generally flat central section and a pair of opposing side sections connecting said central section to adjacent ones of said conical side wall portions, said central section extending upwardly and outwardly from said bottom wall, said pair of opposing side sections of each of said webs forming surface portions of a curved surface of a respective imaginary upright cone, said central section of each of said webs defining a truncated parabolic conic section of said respective imaginary upright cone.

11. The pocket of claim 10, wherein said plurality of side wall portions include three side wall portions circumferentially spaced at equal distances from each other, and wherein said plurality of webs include three webs circumferentially spaced at equal distances from each other.

12. A pocket of a beverage cup carrier, said pocket comprising:

a bottom wall;

a plurality of generally conical side wall portions encompassing said bottom wall and extending upwardly and outwardly from said bottom wall, said side wall portions being circumferentially spaced from each other;

a plurality of circumferentially spaced, webs interconnecting said plurality of side wall portions, said webs extending radially inwardly relative to said side wall portions; and a plurality of denesting lugs interconnecting said bottom wall and respective ones of said side wall portions, said denesting lugs extending inward from said respective ones of said side wall portions.

13. The pocket of claim 12, wherein each of said denesting lugs is circumferentially located approximately at a center of a respective one of said side wall portions.

14. The pocket of claim 13, wherein a cross-section of each of said denesting lugs taken in a plane generally parallel to said bottom wall is generally semi-circular in shape.

15. A pocket of a beverage cup carrier, said pocket comprising:

a bottom wall;

a plurality of generally conical side wall portions encompassing said bottom wall and extending upwardly and outwardly from said bottom wall, said side wall portions being circumferentially spaced from each other;

a plurality of circumferentially spaced, inwardly extending webs interconnecting said plurality of side wall portions; and a plurality of denesting lugs interconnecting said bottom wall and respective ones of said side wall portions, said denesting lugs extending inward from said respective ones of said side wall portions, said denesting lugs supporting a peripheral bottom portion of a large beverage cup to cause said large beverage cup to be vertically spaced from said bottom wall of the pocket in response to inserting said large beverage cup into the pocket, said denesting lugs failing to support a peripheral bottom portion of a small beverage cup in response to inserting said small beverage cup into the pocket.

16. A beverage cup carrier, comprising:

first and second pockets arranged in laterally spaced relation, each of said pockets including a bottom wall;

a plurality of generally conical side wall portions encompassing said bottom wall and extending upwardly and outwardly from said bottom wall, said side wall portions being circumferentially spaced from each other, said side wall portions of said first pocket forming surface portions of a curved surface of a first imaginary inverted cone, said side wall portions of said second pocket forming surface portions of a curved surface of a second imaginary inverted cone; and a plurality of circumferentially spaced webs interconnecting said plurality of side wall portions, said webs of said first pocket extending radially inward from said curved surface of said first imaginary cone, said webs of said second pocket extending radially inward from said curved surface of said second imaginary cone, part of one of said webs of said first pocket and pan of one of said webs of said second pocket forming surface portions of a curved surface of an imaginary upright cone intersecting said first and second imaginary inverted cones.

17. The beverage cup carrier of claim 16, wherein each of said webs includes a generally flat central section and a pair of opposing side sections connecting said central section to adjacent ones of said conical side wall portions, said central section extending upwardly and outwardly from said bottom wall.

18. The beverage cup carrier of claim 17, wherein said pair of opposing side sections of said one of said webs of said first pocket and said pair of opposing side sections of said one of said webs of said second pockets form said surface portions of said curved surface of said imaginary upright cone.

19. The beverage cup carrier of claim 18, wherein said central section of said one of said webs of said first pocket and said central section of said one of said webs of said second pocket define respective truncated parabolic conic sections of said imaginary upright cone.

20. A pocket of a beverage cup carrier, said pocket comprising:

a bottom wall;

a plurality of generally conical side wall portions encompassing said bottom wall and extending upwardly and outwardly from said bottom wall, said side wall portions being circumferentially spaced from each other; and a plurality of circumferentially spaced, inwardly extending webs interconnecting said plurality of side wall portions, each of said webs being vertically spaced from said bottom wall to define a respective elongated slot therebetween, said slot being elongated in a direction generally parallel to said bottom wall, each of said webs including a generally flat central section and a pair of opposing curved side sections connecting said central section to adjacent ones of said conical side wall portions, said central section extending upwardly and outwardly from said bottom wall.

* * * * *